US005787966A

United States Patent [19]

Lestani et al.

[11] Patent Number: 5,787,966

[45] Date of Patent: Aug. 4, 1998

[54] DEVICE FOR THE CONTINUOUS CASTING OF PRODUCTS HAVING A ROUND CROSS-SECTION AND PRODUCTS HAVING A CROSS-SECTION WITH FLAT SIDES

[75] Inventors: Dario Lestani, Bicinicco Fraz. Cuccana; Daniele Merlino, Moruzzo Fraz. Brazzacco; Domenico Wogler Ruzza, Udine, all of Italy

[73] Assignee: Danieli & C. Officine Meccaniche SpA, Buttrio, Italy

[21] Appl. No.: 536,279

[22] Filed: Sep. 29, 1995

[30] Foreign Application Priority Data

Sep. 30, 1994 [IT] Italy ..... UD94 A 00158

[51] Int. Cl.[6] ..... B22D 11/12; B22D 11/128

[52] U.S. Cl. ..... 164/442; 164/448

[58] Field of Search ..... 164/442, 448

[56] References Cited

U.S. PATENT DOCUMENTS

| | | | |
|---|---|---|---|
| 4,180,122 | 12/1979 | Sevastakis | 164/448 |
| 4,640,338 | 2/1987 | Kumagai | 164/448 |
| 4,699,198 | 10/1987 | Schultheiss | 164/442 X |
| 5,238,047 | 8/1993 | Sakata | 164/442 X |

FOREIGN PATENT DOCUMENTS

| | | | |
|---|---|---|---|
| 58-97474 | 6/1983 | Japan | 164/442 |
| 59-50961 | 3/1984 | Japan | 164/442 |
| 213300 | 5/1968 | U.S.S.R. | 164/448 |
| 2105229 | 3/1983 | United Kingdom . | |

OTHER PUBLICATIONS

Patent Abstract of Japan, vol. 12, No. 018 —Abstract of JP A 62–176654 (Sumitomo Heavy Ind. Ltd.) Aug. 1987.

Patent Abstracts of Japan, vol. 13, No. 094 —Abstract of JP A 63–286259 (Sumitomo Metal Ind. Ltd.) Nov. 1988.

Patent Abstracts of Japan, vol. 12, No. 018 —Abstract of JP A 62–176651 (Sumitomo Heavy Ltd.) — Aug. 1987.

Abstract of (Bardin Ferr Metallurgy) Mar. 1981 U.S.S.R. Inventor's Certificate 812,420.

*Primary Examiner*—J. Reed Batten, Jr.

*Attorney, Agent, or Firm*—Antonelli, Terry, Stout & Kraus, LLP

[57] ABSTRACT

The device includes at least a mould (11) with a replaceable crystallizer (12), a downstream mould portion, a containing, guiding and cooling roller conveyor (14) and an extraction and straightening assembly (15). The extraction and straightening assembly (15) includes drawing rolls (16) with a flat portion (18) and with a longitudinally arranged circumferential outline portion (17) for round products, the lateral reciprocal position of the drawing rolls (16) in relation to the longitudinal axis of the mould (11) being able to be varied from a first position for the casting of round products (13*a*) to a second position for the casting of products with flat sides (13*b*).

12 Claims, 2 Drawing Sheets

DEVICE FOR THE CONTINUOUS CASTING OF PRODUCTS HAVING A ROUND CROSS-SECTION AND PRODUCTS HAVING A CROSS-SECTION WITH FLAT SIDES

BACKGROUND OF THE INVENTION

This invention concerns a device for the continuous casting of products with a round cross-section and products with a cross-section with flat sides.

To be more exact, the invention concerns a device suitable to cast products having different forms of cross-section and, in particular, suitable to cast products with substantially flat sides or surfaces and round products.

By products with flat surfaces are meant products having a square, rectangular or diamond-shaped cross-section or polygonal products in general, whereas by round products are meant circular or oval products or the like.

This invention makes possible an adaptation to the casting of flat and round shapes without requiring great operational and/or structural work on the casting machine.

The invention enables the problems to be overcome of surface deformation of the products due to the action of assemblies not specifically suitable for the form of the cast product.

The state of the art covers the problems encountered with continuous casting machines with regard to the casting of products having different shapes of their cross-section.

In fact, it has been found that the extraction and straightening assembly included downstream of the mould acts on the cast product with a given pressure to prevent problems of the sliding and movement of the product itself being extracted.

It has also been found that the rolls which form the extraction and straightening assembly, and generally all the drawing, containing and/or guiding rollers positioned downstream of the mould, generally have a flat surface and are not otherwise shaped and are therefore pre-arranged to work on shapes of cross-section which are substantially flat.

The plants of the state of the art for continuous casting therefore commonly accept as unavoidable the deformations caused by the action of those rolls where a round product is being cast.

In particular, these deformations are to be found in the formation of flattened portions on the product both on the inner curved side and on the outer curved side of the product, these flattened portions coinciding with the zones of the gripping of the rolls against the round product.

One alternative is to replace the whole assembly of drawing and extraction rolls positioned downstream of the mould whenever changing from a product with flat surfaces to a round product.

This solution, however, is often impossible for obvious reasons of loss of time, high costs, the requirement of a labor force, the availability of parts, and for logistic problems in the works as well as for yet other reasons.

The present applicants are not aware of solutions which are efficient and, at the same time, simple for the solution of this problem, and the present applicants have therefore designed, tested and embodied this invention to overcome this problem.

SUMMARY OF THE INVENTION

The purpose of the invention is to provide a device for the continuous casting of products with substantially flat surfaces and of round products which is able to overcome the problems of surface deformations due to the machines of the state of the art in the changeover from one type of product to the other type.

According to the invention the continuous casting device employs a mould of a conventional type, the crystalliser of which is of a replaceable type and can be normally diversified according to the product to be cast.

Moreover, the mould is associated at its lower end with conventional assemblies such as the containing means having a straight segment and a curved segment and cooperating generally with the usual cooling systems included at the outlet from the crystalliser.

According to the invention the extraction and straightening assembly has its drawing rolls conformed according to the shape of the product to be cast.

To be more exact, each drawing roll of the extraction and straightening assembly includes on its substantially flat surface at a determined position along its length at least one circumferential outline for round products.

This circumferential outline is suitable to grip a round product without causing thereupon buckling deformations during the extraction of the product.

This circumferential outline has advantageously a shape, depth and width mating substantially with the cross-section of the round product being cast.

By employing such a drawing roll it is therefore possible to adapt the casting device to the shape of this product by displacing the extraction and straightening assembly in an axial direction substantially perpendicular to the direction of feed of the cast product.

In other words, where a round product is being cast, the circumferential outline included on the drawing roll is arranged to coincide with the casting axis of that product, whereas, when a product with flat surfaces is being cast, the flat part of the surface of the drawing roll is arranged to coincide with that casting axis.

According to a variant, besides the lateral displacement on a substantially horizontal plane, a displacement on a vertical plane is also induced in the extraction and straightening assembly so as to compensate the variation which has taken place in the casting axis during the change from the casting of round products to the casting of products with flat surfaces.

Where the continuous casting machine is a multiple machine, each extraction and straightening assembly is made capable of an independent traversing movement carried out, for instance, by a bridge crane.

The basic frame on which that assembly is installed is pre-arranged to provide the double capability of installation.

According to a variant the multiple continuous casting machine has all its own extraction and straightening assemblies installed on one single frame capable of at least lateral movement, for instance on a counterframe.

According to this variant one single movement with one single actuation displaces all the assemblies at the same time, thus preparing the machine quickly and simply for the new shape of product to be cast.

According to a variant, so as to ensure a correct guiding of the differing cast products, the containing and guiding rollers too positioned in the curved segment are conformed and optimised according to the form of the differing cross-sections of the products to be cast.

To be more exact, these containing and guiding rollers too have a circumferential outline which is arranged during working so as to coincide with the nominal casting axis of the product.

In this case the mould is at least associated with displacement means for changing the radius of the extraction trajectory of the cast product according to its shape, particularly so where the product is round or has flat surfaces.

In other words, when the nominal radius of the casting machine has been arranged as being that used for round cross-sections and there is then a change to the casting of shapes with flat surfaces, the mould will be displaced by a value which corresponds substantially to the depth of the circumferential outline included in the containing and guiding rollers of the curved segment.

According to a variant the mould is kept stationary while the containing and guiding rollers are displaced by a value corresponding to the depth of the outline, the purpose being to change the casting radius according to the shape of the cast product.

According to another embodiment of the invention the casting device includes a mould with a constant casting radius which can be displaced laterally in relation to the extraction and straightening assembly, which in this case is kept stationary.

In this variant the mould has two working positions defining two casting axes, namely a first axis for casting round products and a second axis for casting products with flat surfaces.

The first casting axis will pass in coincidence with the circumferential outline on the drawing rolls, whereas the second casting axis will pass in coincidence with the flat surface of the drawing rolls.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
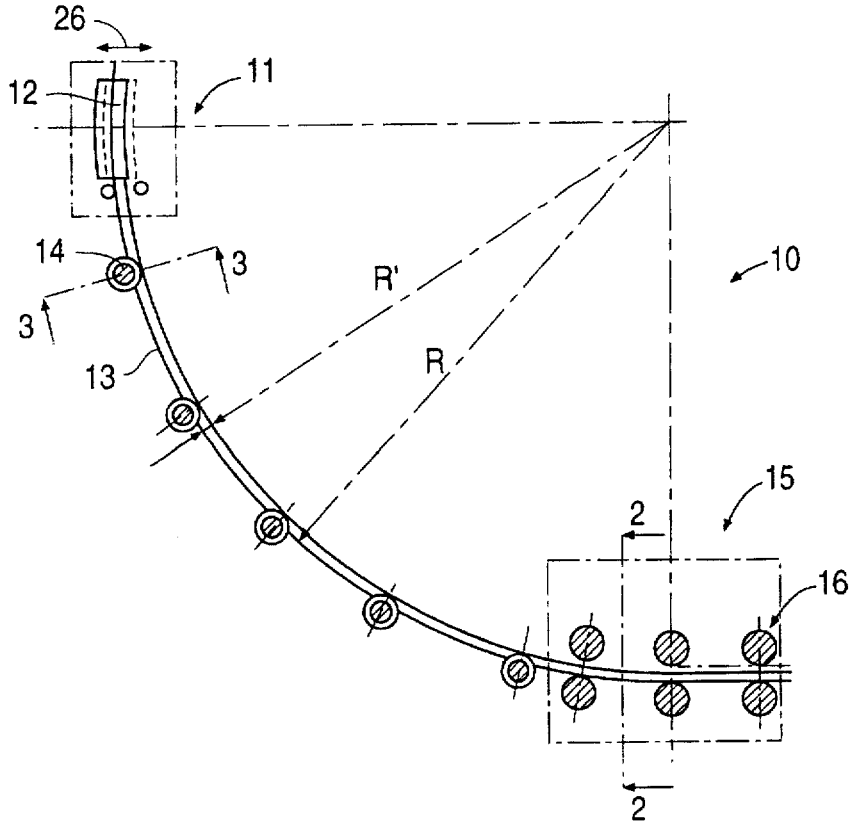
FIG. 1 is a diagram of the continuous casting device according to the invention.

A continuous casting device 10 shown in FIG. 1 includes a mould 11, a crystalliser 12 of which can be replaced to suit the cross-section of a product 13 to be cast.

A plurality of containing and guiding rollers 14 are comprised conventionally in prolongation of the mould 11 and define a curved trajectory for the cast product 13.

The containing and guiding rollers 14 accompany the cast product 13 to an extraction and straightening assembly 15, which in turn delivers the product 13 to a shearing zone and to downstream working assemblies.

According to the invention the extraction and straightening assembly 15 is equipped with drawing rolls 16 positioned adjustably to suit the shape of the cross-section of the cast product 13, whether that product be round **13*a* or with substantially flat surfaces 13*b***.

Figure 5:
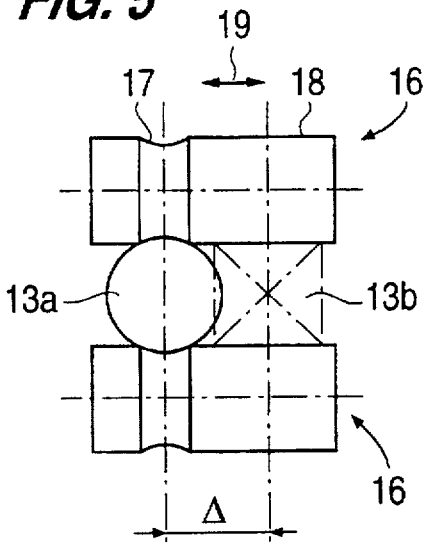
FIG. 5 is a diagram of a detail of the drawing roll of the extraction and straightening assembly used in the device according to the invention.

In particular, each drawing roll 16 includes at a determined position along its length a circumferential outline 17 conformed to grip a round cast product **13*a*, whereas the remainder of its surface 18** is substantially flat (FIG. 5).

In the change from the casting of a round cast product **13*a* to a product with substantially flat surfaces 13*b* each roll 16 of the extraction and straightening assembly 15 is displaced laterally according to a direction defined by its own lengthwise axis and referenced with 19 in FIG. 5; this displacement enables the extraction and straightening assembly 15** to be adapted to the new shape of the cast product.

The value "Δ" of this displacement has to be enough to have the effect that the roll 16 cooperates with the casting axis 25 at a first position corresponding to its circumferential outline 17 and at a second position corresponding at least to its flat surface portion 18.

Each drawing roll 16 therefore has at least two working positions, a first position for round products **13*a* and a second position for products with flat surfaces 13*b***.

In the event of multiple casting with a plurality of casting lines, the extraction and straightening assemblies 15 associated with each casting line can be fitted to one single frame 20 capable of being moved in this case by the actuation of a hydraulic cylinder/piston actuator 21 on a mating counterframe 22.

The clamping of the frame 20 on the counterframe 22 in the two working positions is provided by hydraulic vices 23.

Figure 7:
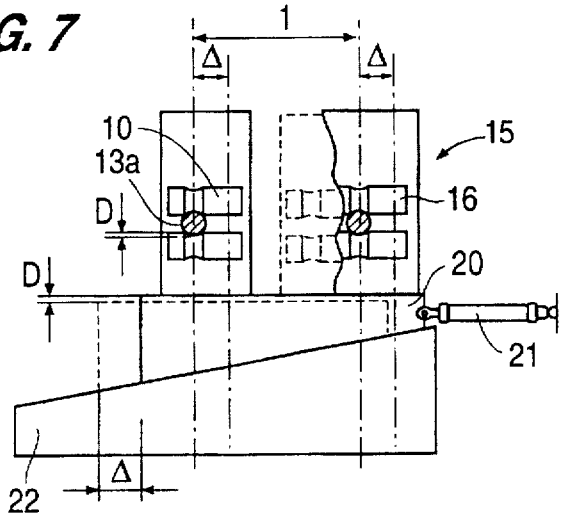
FIG. 7 is a variant of FIG. 2.

According to the variant of FIG. 7 the frame 20 and counterframe 22 have a development with an inclined surface.

In this way the lateral displacement imparted by the actuator 21 so as to position the drawing rolls 16 correctly according to the shape of the cast product 13 causes also a raising or lowering of the extraction and straightening assembly 15.

This raising or lowering makes possible the compensation, on the vertical plane of the casting axis 25, of the variation caused by the change from the casting of a round product **13*a* to the casting of a product with flat surfaces 13*b***.

In this case the casting lines have a distance between centres "I" which is advantageously slightly greater than the distance between centres normally present on multiple casting machines for adaptation to the double positioning of the drawing rolls 16.

According to the invention the containing and guiding rollers 14 too are conformed according to the shapes of the product 13 to be cast and include a circumferential outline **17*a* which in the working position is positioned along the length of the rollers so as to coincide with the casting axis 25**; in this case the circumferential outline has a depth "D".

So as to obtain an efficient and correct guiding of the product 13 along the curved trajectory down to the extraction and straightening assembly 15, the mould 11 is made movable according to the directions marked with 26 in FIG. 1 for the purpose of defining two casting radii according to the product 13 to be cast.

In particular, a first nominal casting radius "R" is defined for the casting of round products **13*a* and a second nominal casting radius "R'" is defined for the casting of products with flat surfaces 13*b***.

The value of the displacement of the mould 11 and therefore the difference between the first casting radius "R"

and the second casting radius "R'" are "D", that is to say, the depth of the outline 17*a* included in the containing and guiding rollers 14.

Figure 3:
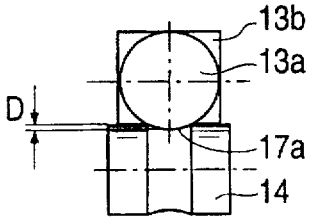
FIG. 3 shows the section B—B of FIG. 1.

This displacement makes possible the determination of the correct and ideal coupling between the cast product 13 and the containing and guiding roller 14 (FIG. 3), with relative correct positionings as between the round product 13*a* and the circumferential outline 17*a* and, respectively, between the product with flat surfaces 13*b* and the flat surfaces 18 of the containing and guiding roller 14.

According to a variant the correct coupling between the product 13 and the containing and guiding roller 14 is achieved by displacing each of the rollers 14 and by keeping the mould 11 stationary.

In this case too the displacement of the rollers 14 has a value "D" and enables the casting radius to be adjusted from the value "R" to the value "R'" in the change from the casting of round products 13*a* to the casting of products with flat surfaces 13*b*.

Figure 8:
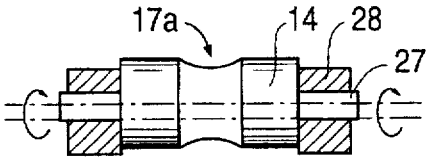
FIG. 8 shows a form of embodiment for the displacement of the containing and guiding rollers.
Figure 4:
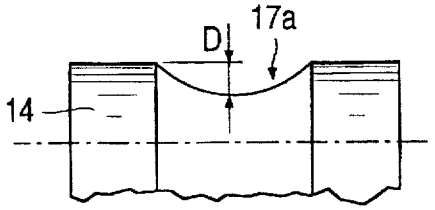
FIG. 4 shows a detail of a containing and guiding roller used in the device according to the invention.
Figure 2:
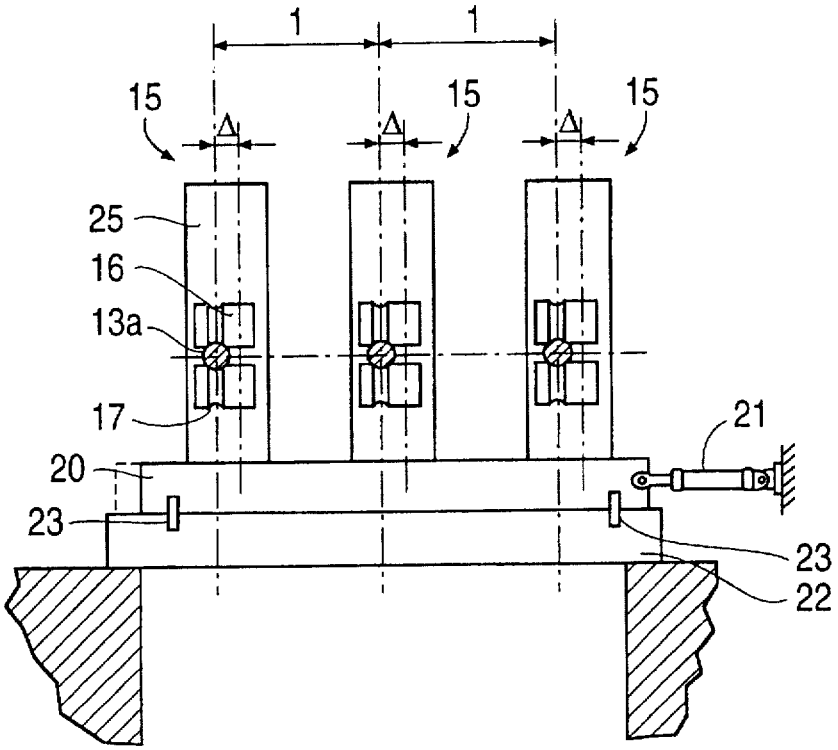
FIG. 2 shows the section A—A of FIG. 1.

A simple embodiment for achieving this displacement of the containing and guiding rollers 14 is shown in FIG. 8, in which the shaft 27 of the rollers 14 is associated eccentrically with a wheel 28, which when set in rotation in one direction or the other causes respectively a raising or a lowering of the relative roller 14.

Figure 6:
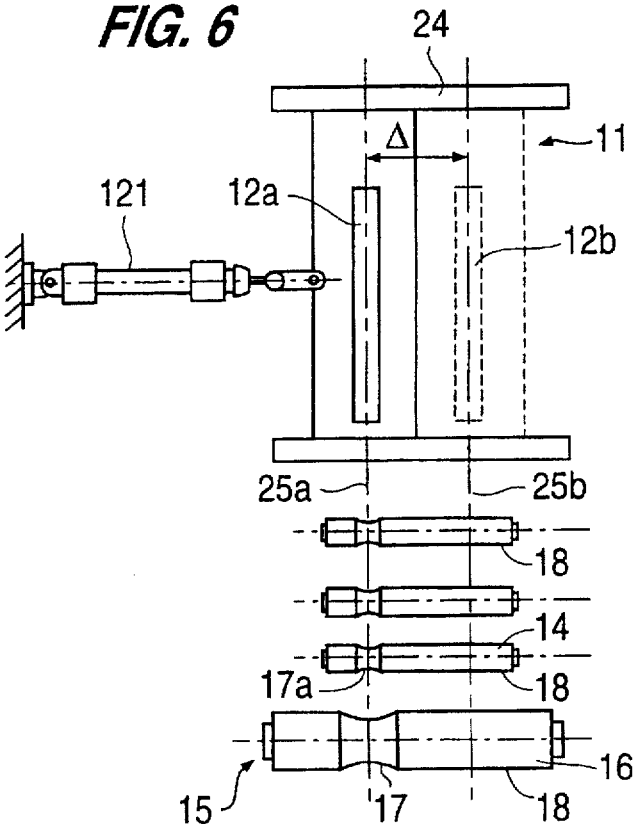
FIG. 6 is a diagram of a variant of the device according to the invention.

The variant of FIG. 6 shows the situation in which in the change from the casting of a round product 13*a* to the casting of a product 13*b* with flat surfaces the extraction and straightening assembly 15 is kept stationary, whereas the casting axis 25 is changed laterally, given an equal nominal radius of casting "R".

In particular, the mould 11 moves on guides 24 and is associated with a cylinder/piston displacement actuator 121 to displace the crystalliser 12, for instance, from a position 12*a* defining a first casting axis 25*a* to a position 12*b* defining a second casting axis 25*b*. The value of the displacement in this case too is "Δ".

According to this embodiment the first casting axis 25*a* is the casting axis for round products 13*a* and encounters the containing and guiding rollers 14 and the drawing rolls 16 of the extraction and straightening assembly 15 at their circumferential outlines 17*a* and 17.

The second casting axis 25*b* is the casting axis for products with flat surfaces 13*b* and encounters the containing and guiding rollers 14 and the drawing rolls 16 of the extraction and straightening assembly 15 at their flat surfaces 18.

We claim:

1. Device for the continuous casting of products having a round cross-section and products having a cross-section with flat sides, comprising: a mould with a replaceable crystalliser; a downstream mould portion; a containing, guiding and cooling roller conveyor; an extraction and straightening assembly, wherein the extraction and straightening assembly includes drawing rolls having a flat portion and having a longitudinally arranged circumferential outline portion for round products, and means for changing a lateral reciprocal position of the drawing rolls at least with respect to the longitudinal axis of the mould between a first position for the casting of round products and a second position for the casting of products with flat sides.

2. Device as in claim 1, in which the longitudinal axis of the mould in the first position encounters the drawing rolls at their relative circumferential outline portion.

3. Device as in claim 2, in which the longitudinal axis of the mould in the second position encounters the drawing rolls at their relative flat surface.

4. Device as in claim 1, in which the means for changing a lateral reciprocal position of the drawing rolls with respect to the longitudinal axis of the mould comprises an actuator for moving the extraction and straightening assembly at least laterally along the longitudinal axis of the drawing rolls from a first position for the casting of round products, with the circumferential outline portion aligned with a casting axis, to at least a second position for the casting of products with flat sides, with a flat surface portion aligned with the casting axis.

5. Device as in claim 4, in which the extraction and straightening assembly can also be moved vertically.

6. Device as in claim 5, wherein the extraction and straightening assembly is mounted on a frame to which the actuator is connected, the frame being slidable on a mating counterframe, wherein mating surfaces of the frame and counterframe are inclined, whereby lateral movement of the frame by the actuator causes a vertical movement of the frame and the extraction and straightening assembly mounted thereon.

7. Device as in claim 1, in which the means for changing a lateral reciprocal position of the drawing rolls with respect to the longitudinal axis of the mould comprises an actuator for moving at least the crystalliser at least laterally from a first position for the casting of round products to a second position for the casting of products with flat sides, the position of the extraction and straightening assembly being kept stationary.

8. Device as in claim 1, in which the containing and guiding rollers include in their length at least one circumferential outline for round products, this circumferential outline having a depth of "D".

9. Device as in claim 6, in which the mould can be moved at least radially from a first position for the casting of round products, this first position defining a first casting radius "R", to a second position for the casting of products with flat sides, this second position defining a second casting radius "R'", this displacement of the mould having a value "D".

10. Device as in claim 6, in which the containing and guiding rollers can be moved at least radially from a first position for the casting of round products to a second position for the casting of products with flat sides, the position of the mould being kept stationary.

11. Device as in claim 1, wherein the round products have a circular cross-section.

12. Device as in claim 1, wherein the round products have an oval cross-section.

* * * * *